US005159962A

United States Patent [19]

Dow

[11] Patent Number: 5,159,962

[45] Date of Patent: Nov. 3, 1992

[54] CONTAINER FILLING MACHINE, PARTICULARLY FOR CONCENTRATED LIQUID PIGMENT

[75] Inventor: Warren A. Dow, St. Louis, Mo.

[73] Assignee: Harcros Pigments, Inc., East St. Louis, Ill.

[21] Appl. No.: 681,140

[22] Filed: Apr. 5, 1991

[51] Int. Cl.[5] ..... B65B 3/04

[52] U.S. Cl. ..... 141/98; 141/94; 141/95; 141/86; 141/88; 141/84; 141/198; 141/174; 141/387; 141/370

[58] Field of Search ..... 141/94, 95, 96, 83, 141/86, 88, 84, 192, 198, 98, 196, 311 R, 369, 370, 31, 174, 373, 195, 387; 138/30

[56] References Cited

U.S. PATENT DOCUMENTS

| | | | |
|---|---|---|---|
| 1,959,694 | 5/1934 | Stevens . | |
| 2,472,921 | 6/1949 | Quimper | 141/88 X |
| 2,598,665 | 6/1952 | Levings | 141/88 |
| 3,087,517 | 4/1963 | Magnuson et al. | 141/88 X |
| 3,094,154 | 6/1963 | Daniels | 141/88 |
| 3,382,897 | 5/1968 | Skiera et al. | 141/369 X |
| 3,476,158 | 11/1969 | Retzler | 141/84 |
| 3,511,468 | 5/1970 | Young . | |
| 3,536,925 | 10/1970 | Schmidt . | |
| 3,605,581 | 9/1971 | Von Forell . | |
| 3,702,625 | 11/1972 | Schmidt | 141/1 |
| 3,878,867 | 4/1975 | Dirks . | |
| 3,913,792 | 10/1975 | Brill et al. | 141/370 X |
| 3,916,963 | 12/1975 | McIntosh | 141/198 |
| 3,942,563 | 3/1976 | Connors et al. | 141/88 |
| 4,015,645 | 4/1977 | Chamberlin . | |
| 4,236,553 | 12/1980 | Reichenberger | 141/198 |
| 4,403,764 | 9/1983 | Repplinger . | |
| 4,437,497 | 3/1984 | Enander | 141/1 |
| 4,559,979 | 12/1985 | Koblasz et al. | 141/9 |
| 4,567,926 | 2/1986 | Lichfield et al. | 141/392 X |
| 4,658,872 | 4/1987 | Ellis . | |
| 4,737,801 | 4/1988 | Ichihashi et al. | 141/198 X |
| 4,759,387 | 7/1988 | Arendt . | |
| 4,890,651 | 1/1990 | Stembridge et al. | 141/1 |
| 4,912,976 | 4/1990 | Labriola II | 141/95 X |

OTHER PUBLICATIONS

"Spectrum 1" Beltron Corporation (no date).

"Spectrum 1 Standard Model," Beltron Corporation (no date).

Beltron Corporation Memorandum Mar. 16, 1989.

*Primary Examiner*—Ernest G. Cusick

*Attorney, Agent, or Firm*—Polster, Lieder, Woodruff & Lucchesi

[57] ABSTRACT

A simple, low-cost container filling machine includes a pulse pump for drawing high-density, high viscosity, thixotropic pigment from a shipping container, an accumulator for smoothing flow of the pigment, a non-adjustable and replaceable anti-drip dispensing tube, an adjustable optical level sensor, and electronic means for setting the optical sensor. A fixed platform for containers being filled includes anti-splash and aligment devices.

15 Claims, 3 Drawing Sheets

CONTAINER FILLING MACHINE, PARTICULARLY FOR CONCENTRATED LIQUID PIGMENT

BACKGROUND OF THE INVENTION

This invention relates to container filling devices. It has particular applicability to a low-cost, easy-to-use filling device for dispensing high-viscosity liquid dispersions of iron oxide pigment, although the usefulness of the invention is not limited to that application.

Iron oxide pigments are widely used in industry and commercially to provide yellow, red, and black coloring and blends including these three primary colors. A common example of their use is in coloring concrete and mortar. In these applications, it is frequently useful to have relatively small quantities (a pint, a quart, or up to five gallons) of pigment in colors to match a larger job. Dispensing such small quantities of the pigment into containers for use on a job site is now extremely difficult for a number of reasons.

Synthetic iron oxide powders are commonly dispersed in water to make the fine powder easier to work with. These aqueous dispersions may include small amounts of additives such as surfactants. The aqueous dispersions are dense, having a specific gravity on the order of 2.5. Therefore, handling even relatively small volumes of the dispersions can be awkward, particularly if containers must be lifted in confined areas.

They are abrasive. Therefore, the equipment used in dispensing them must be particularly durable.

They are very viscous and thixotropic; their viscosity varies with temperature, pressure, agitation, color, and other conditions. Obtaining uniform flow is therefore difficult, and timed filling processes cannot generally be used. The variances in viscosity also complicate the problem of avoiding dripping and splashing of the materials. When exposed to air, they become sticky, then harden; they therefore clog orifices, valves and other surfaces they come in contact with.

The liquid pigments are very concentrated. Less than five percent pigment by weight of the cement is required for a concrete masonry mix including one part by weight of standard Portland cement and six parts sand. One quart of liquid pigment is typically used to make one hundred gallons of paint. The pigments are so concentrated that spills are difficult to clean, and handling equipment requires lengthy clean-up. Even a spill of a drop or two may require substantial effort to clean up. Therefore, dispensing equipment which drips after shut-off or which splashes can cause major disruptions. Moreover, switching from one color to another requires cleaning the handling equipment thoroughly to prevent mixing of colors.

Presently known dispensing equipment is expensive, difficult to use, and does not meet the foregoing requirements.

SUMMARY OF THE INVENTION

One of the objects of this invention is to provide a simple, inexpensive container filling machine which will fill a variety of different size containers uniformly to preset levels, even when used with such materials as iron oxide liquid dispersions.

Another object is to provide such a machine which is easily cleaned and which is easily converted from one material (such as one pigment color) to another.

Another object is to provide such a machine which is easily converted from one container size to another, while providing good operating characteristics for a variety of container sizes.

Another object is to provide such a machine which is easy to set up, calibrate, and use.

Another object is to provide such a machine which provides smooth and accurate dispensing of such materials directly from transportation containers such as drums, without handling the materials.

Another object is to provide such a machine which minimizes drips and which prevents drips from splashing or contaminating the bottoms of subsequently filled containers.

Another object is to provide such a machine which does not require lifting the containers being filled, before or after filling, and which may be used conveniently with manual handling of the containers or may be converted to use with automated container position sensing and conveying equipment.

Other objects of this invention will be apparent to those skilled in the art in light of the following description and accompanying drawings.

In accordance with one aspect of this invention, generally stated, a container filling device is provided comprising a source of liquid, a dispensing nozzle, a valve between.the nozzle and the liquid source, a mechanical actuator for the valve, and a horizontal support surface for a container below the nozzle, characterized by barrier means for separating the nozzle and the support surface on a front side of the barrier means from the liquid source and the valve actuator on a rear side of the barrier means. The barrier means is preferably a generally imperforate, vertical plate extending horizontally on either side of the nozzle and extending vertically from the support surface to above an outlet of the nozzle to provide an easily cleaned barrier for mounting and protecting the control circuitry and the valve actuator.

In accordance with another aspect of the invention, the design provides the ability to fill a variety of different size containers uniformly to preset levels. This versatility is achieved by the use of an adjustable level sensing device, interchangeable fill nozzles, and a positioning device which automatically positions a variety of container sizes. Preferably, the positioning device is a pair of positioning rails formed into an open V, and which need be repositioned only for special containers or special filling jobs.

Preferably, the valve is a ball valve and the sensor is a photo-optic sensor.

Preferably, the fill nozzles are attached to an outlet tube by quick-connect couplers, and the outlet tube is fixedly mounted with respect to the container support surface. The nozzle heads are different lengths to provide a nozzle outlet spaced a desired distance above containers of different heights. The nozzles are preferably fabricated by inserting capillary tubes into outer tubes of various sizes, inhibit dripping after the ball valve is closed. The nozzles may also be made different diameters and may have capillary tubes of different sizes, ranging from about 0.05" to about 0.5" in diameter, to facilitate different flow rates and the use of the machine with different fluids. For use with the preferred iron oxide dispersions, diameters of 0.25"+/−0.1" are preferred.

The depth sensor is vertically adjustable with respect to the outlet tube, to provide adjustment for containers of different sizes, different fill levels, different flow rates, and different delays between the time the valve actuator begins to operate and the time flow into the container ceases. The depth sensor is preferably connected to circuit which provides a perceptible indication when the sensor detects that the level of fluid in the container has reached a desired or "full" level. This permits a simple method of setting the position of the level sensor by placing a full container (i.e., one filled to the desired level) in position under the nozzle, then adjusting the level sensor up and down until it indicates a "full" level. A small adjustment may be made, if necessary, to account for any delay from the time the level control circuitry signals the valve actuator to close until the time that flow ceases. That delay will be a function of the flow characteristics of the fluid being dispensed, the speed at which the valve is closed, and any slight flow through the nozzle after valve closure.

A selector switch allows the mode of operation to be changed from automatic to manual. When automatic mode has been selected, a photo-electric sensor switches a pneumatically actuated ball valve, which thus controls the amount of liquid pumped into the container being filled. The height of the fiber optic sensor cable is easily adjusted to allow accurate filling of a wide variety of container sizes. When the selector switch is in manual mode the level sensor does not control the ball valve, although it continues to give a visual indication when a full level is detected, and liquid will be pumped through the nozzle until the fill button is released.

In accordance with another aspect of the invention, the dispensing device is made with a simple, straight-through construction which permits far simpler cleaning than with prior devices, yet permits the use of simple and inexpensive components which provide simple, flexible, accurate, and reliable operation. A pulsating pump, illustratively a pneumatic diaphragm pump, is used to pump a fluid product from a storage vessel, through a pulse dampening device, to the filling machine. The function of the pulse dampener is to partially eliminate the pulsations which are characteristic of a pneumatic diaphragm pump. The pulse dampener preferably provides an unobstructed, easily cleaned passageway and includes a length of flexible tubing for carrying the liquid, a jacket around and spaced from the tubing, and means for controlling pressure in the jacket. An air regulator, mounted on the front of the machine, regulates the pumping speed and pressure of the pneumatic diaphragm pump. A second air regulator, also mounted on the front of the filling machine, adjusts the degree of pulsation compensation by varying the operating pressure of the pulse dampener. This arrangement permits wide adjustability of flow rate and pulse dampening consistent with the material being dispensed, the size of the containers being filled, and the need to eliminate splashing and dripping.

Any dripping which may occasionally occur falls through an opening in the container support. Preferably, the support is in the form of a grate, and the opening is at least as large as the largest internal diameter of the nozzles. Preferably, a drip pan is provided below the support, and the drip pan may optionally be emptied through a pipe fitting in the bottom of the drip pan.

The same quick disconnect feature which allows the nozzles to be easily changed also allows a hose to be quickly attached to the machine, thereby providing a means for quick and thorough flushing of the fill machine, for example by running the inlet to the pump into a water reservoir and running the hose into the same reservoir, to provide a recycled cleaning system. Alternatively, the pump inlet may be run into a water source and the hose to a drain. If the pump is reversible, the hose may be connected to the water source.

Other aspects of the invention will best be understood in light of the following description of the preferred embodiment.

DESCRIPTION OF THE PREFERRED EMBODIMENT

Figure 1:
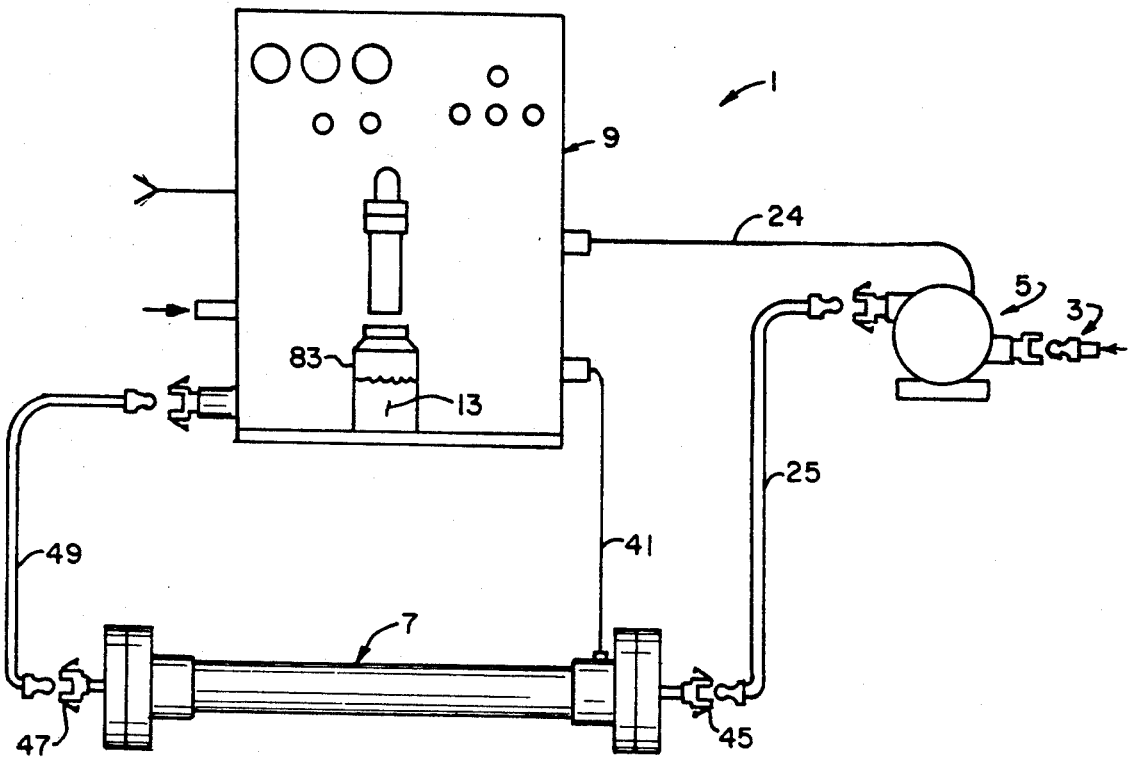
FIG. 1 is a diagrammatic view of one illustrative embodiment of container filling system of the present invention.
Figure 2:
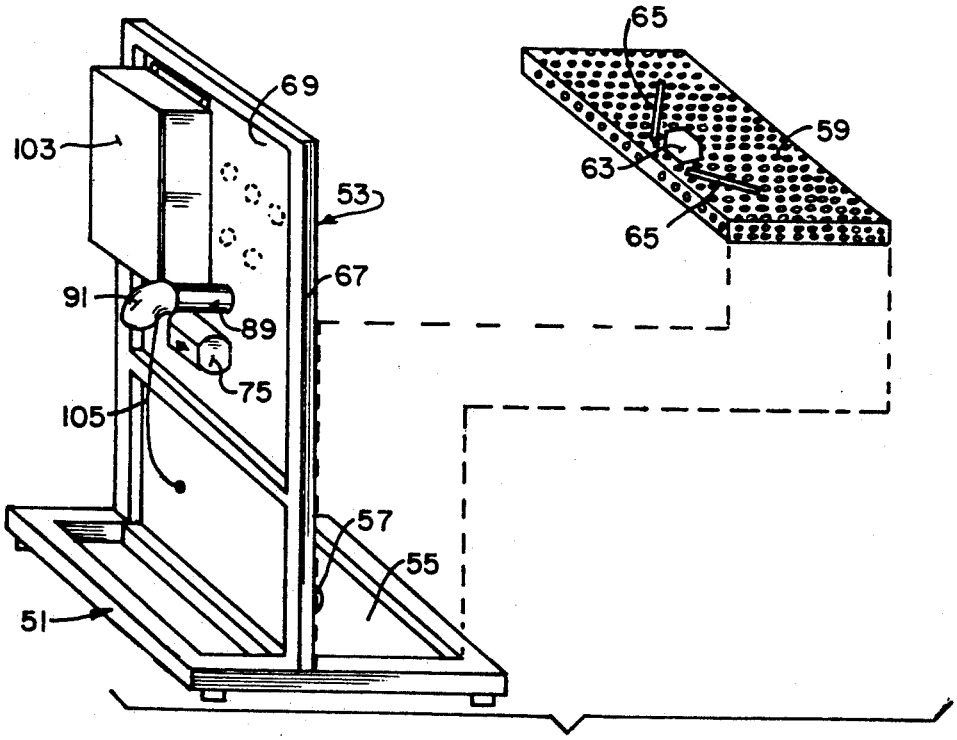
FIG. 2 is a view in perspective of a dispensing portion thereof, shown exploded and somewhat diagrammatically.
Figure 3:
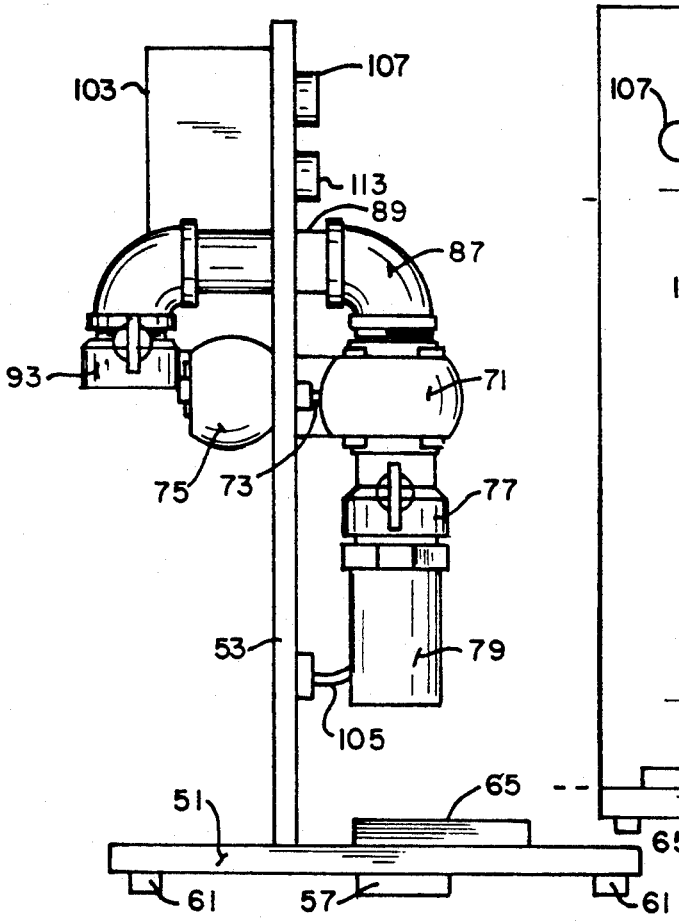
FIG. 3 is a view in side elevation of the dispensing device of FIG. 2.
Figure 4:
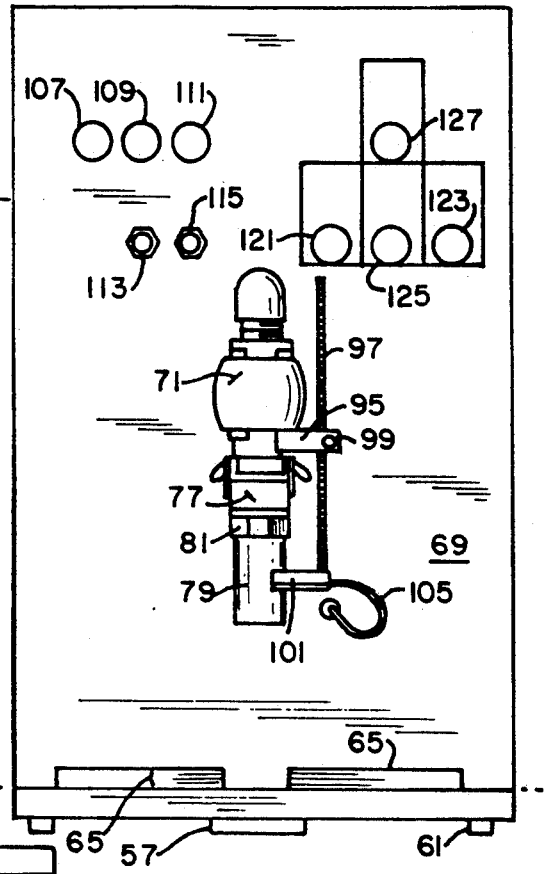
FIG. 4 is a view in front elevation of the dispensing device of FIGS. 2-3.
Figure 5:
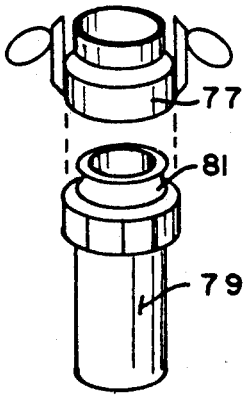
FIG. 5 is an exploded view in perspective of a replaceable nozzle portion thereof, showing its connection to a quick-connect device on an outlet tube portion thereof.
Figure 6:
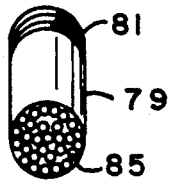
FIG. 6 is a view in perspective of the nozzle portion of FIG. 5, showing capillary tubes friction-fitted therein.

Referring now to the FIG. 1, reference numeral 1 indicates one illustrative embodiment of container filling system of the present invention. The system 1 includes a liquid source 3, a pump means 5, a pulse dampener 7, and a container filling machine 9.

Figure 7:
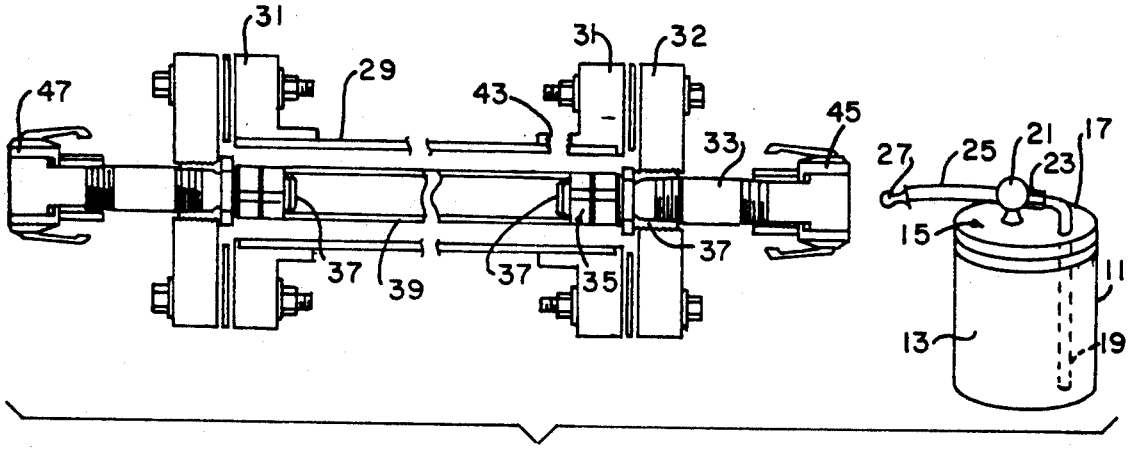
FIG. 7 is a somewhat diagrammatic view of a pulse dampening device portion of the system of FIG. 1.

As shown particularly in FIG. 7, the liquid source 3 is illustratively a fibre drum 11 filled with an aqueous iron oxide pigment dispersion 13, having a high viscosity and abrasiveness, and a density of about 2.5. The drum is typically used for shipping the pigment dispersion in volumes of from two to three hundred gallons. A typical drum carries 600 pounds (30–40 gallons) of pigment dispersion. The pump means 5 is illustratively a pump and lid (PAL) device 15 including a replacement lid 17 for the fibre drum, a dip tube 19 extending through the lid 17 essentially to the bottom of the drum 11, and a dual chamber pneumatic diaphragm pump 21 mounted on the lid 17 and connected to the dip tube 19 by a standard quick-disconnect coupling 23. The coupling 23, and the other quick-disconnect couplings used in the system, are illustratively cam-and-groove couplers having a female part with cam levers for engaging and locking a shallow circumferential groove in the mating male part. The pump 21 provides a continuous pulsed output having a velocity and volume dependent on the viscosity of the pigment dispersion, the size of the pump, and the pressure of the air through line 24 which operates the pump.

The pulse dampener 7 is connected to the output side of the pump 21 by a hose 25 having a quick-disconnect male adapter 27 on its end. The pulse dampener 7 includes an outer pipe or jacket 29 formed of a two-inch diameter, five-foot long Schedule 80 PVC tube. The jacket 29 carries on each of its end flanges 31 a blind flange 32. An outwardly-extending nipple 33 is threaded into a pair of inwardly-extending one-inch brass hose barb 37, which is in turn threaded into the blind flange 32. The hose barbs 37 carry between them a one-inch diameter, five-foot long flexible tube 39 made of reinforced rubber and held to the barbs 37 by hose clamps 35. The flexible tube 39 expands and contracts in response to the relative pressure in it as compared with the pressure in the annular space between the tube 39 and the jacket 29. Pressure in the annular space between tube 39 and jacket 29 is controlled by an air line 41 attached to an inlet 43 in one of the end flanges 31. One of the nipples 33 is attached by a quick-disconnect coupling 45 to the hose 25 from the diaphragm pump 21, and the other nipple 33 is connected by a quick-disconnect coupling 47 to a hose 49 extending to the filling machine 9.

The filling machine 9 includes a horizontal base 51 and a vertical barrier 53 welded to the base 51. The base is about 25" (63 cm) wide by 25" (63 cm) deep, and the barrier 53 is about 42" (106 cm) high from the bottom of the base.

The base 51 is formed of a square tubing frame and includes, on a front side of the barrier 53, a shallow basin part 55. The basin is about 23" wide by 14" deep and has a 2.5" (6 cm) drain 57. A grid 59 is removably mounted in the basin. The grid 59 is formed of a perforated stainless steel plate, with bent margins forming an inverted tray. The grid fits into the basin with the horizontal upper surface of the grid 59 flush with the upper rim of the basin 55, to form a generally smooth horizontal surface. Feet 61 on the base 51 are provided for setting the filling machine 9 on a table, but it is preferred that the machine 9 be recessed into a counter top, so that the rim of the basin 55 and the grid 59 are flush with the counter top, for ease of moving containers across the counter top.

The grid 59 is provided with an opening 63 formed as a hexagon having a maximum diameter of about ten cm. This size is smaller than the smallest diameter container (one pint or 0.5 liters) to be filled with the machine 9, but larger than the diameter of the largest nozzle used on the machine, as explained in more detail hereinafter. The opening 63 is spaced about 4" from the back of the grid 63. Perforations in the grid are sized to provide easy clean-up of the grid surface. The opening 63 is preferably cut between perforations, so as to avoid sharp edges.

Two guide rails 65 are mounted on the horizontal surface of the grid 59. Each rail 65 is about one-inch square and about twelve inches long. The rails 65 are positioned by feet extending into the perforations of the grid 59, to form a shallow "V" having an opening of about 1" at its apex. The sides of the "V" extend about 1" behind the hexagonal opening 63 in the grid 59. The rails 65 thus provide a guide for positioning a container over the opening 63, although only the smallest containers will be centered over the opening 63.

The vertical barrier 53 includes a square tubing frame 67 and a steel plate 69 mounted to the front of the frame 67.

Mounted to the front of the plate 69, about 21" from the grid 59, is a ball valve 71. The ball valve 71 has a 1.5" passage through it. The stainless steel ball is turned from an open to a closed position by a valve stem 73 extending through the plate 69. A pneumatic actuator 75, mounted on the rear of the plate 69, controls opening and closing of the valve 71. The ball valve 71 and actuator 75 combination is a standard device, sold for example by Worchester Controls, as its Model 1039. At the lower, outlet, side of the valve 71 is mounted a female quick-disconnect coupler 77. The coupler 77 releasably holds an outlet nozzle 79 having a male adapter part 81 at its upper end. The nozzle 79 is one of several such nozzles connectable to the coupler 77, each nozzle having a different diameter (hence flow rate) and a different length to position the nozzle about 0.5" to 2" above the upper rim of a container 83 to be filled by the system 1. The illustrative nozzle 79 is one inch in diameter and five inches long and is made of PVC. The nozzle 79 is filled with twelve quarter-inch PVC capillary tubes 85, extending from below the adapter 81 to the lower end of the nozzle 79. The capillary tubes are inserted into the nozzle 79 before the adapter 81 is attached. Tubes are added until they are frictionally secured in the nozzle, then trimmed. If necessary, the last tube may be cut in half, and the halves forced into the nozzle from opposite ends of the nozzle 79. This simple arrangement has been found to be extremely effective in preventing drips with the high viscosity iron oxide dispersions of the preferred embodiment.

At the upper, inlet, end of the ball valve 71, is attached an elbow 87. A nipple 89 extends through an opening in the plate 69 and connects the elbow 87 to a second elbow 91 on the rear of the plate 69. The second elbow 91 is connected by a quick-disconnect coupling 93 to the hose 49.

Mounted to the casing of the ball valve 71 is a bracket 95. The free end of the bracket 95 carries a vertical rod 97, which is slidably held by the bracket 95. The vertical and rotational positions of the rod 97 may be secured by a thumb screw 99 on the bracket 95. The rod 97 preferably is scribed with calibration marks for ease of adjustment. At the lower end of the rod 97 is carried an optical depth sensor 101. The depth sensor 101 is a commercially available device, sold by Electronics Corporation of America as its 42-500 series Photoswitch. Briefly, it operates by transmitting an optical beam which is reflected by an interface below it. When the interface, typically a liquid surface, is spaced a predetermined distance from the optical beam, the beam is reflected to a sensor. Suitable electronic equipment associated with the sensor determines when the interface is the predetermined distance from the sensor and produces a signal indicative of that fact. The electronic circuitry may, for example, include delay or discrimination circuits to prevent false signals based on instantaneous reflections from ripples in the surface. This circuitry is mounted in an electrical enclosure 103 on the rear face of the plate 69 and is connected to the sensor 101 by a flexible optical cable 105, extending through the plate 69.

Three pressure gauges 107, 109, and 111 are mounted on the plate 69, for indicating respectively the pressure of air supplied to the system, the pressure supplied to the diaphragm pump 21, and the pressure in the annular space between the tube 39 and jacket 29. Pressure control valves 113 and 115, mounted below the gauges 109 and 111, respectively, control the speed of the pump 21, hence the flow rate of the liquid being dispensed, and the amount of pulse dampening and flow restriction caused by the pulse dampener 7. The settings of these two valves must, of course, be chosen together for a particular material, a particular nozzle, a particular container size, and a desired flow rate.

Two lighted electrical control buttons 121 and 123 are also mounted through the plate 69. The first switch 121 is a pull-on push-off main control for the system. The second switch 123 is a momentary contact "fill start" push switch. In a manual mode of the system, the switch 123 is held until the container is filled to a desired level. In an automatic mode, the switch 123 is pushed to start the filling operation, and filling is automatically terminated when the sensor 101 detects that the container has been filled to the proper height.

Also mounted on the vertical plate 69 is a manual-/automatic selector switch 125 and a "full" light 127 activated by the sensor circuitry.

A housing, not shown, is mounted to the tubing frame 67 and surrounds the rear of the machine 9.

Figure 8:
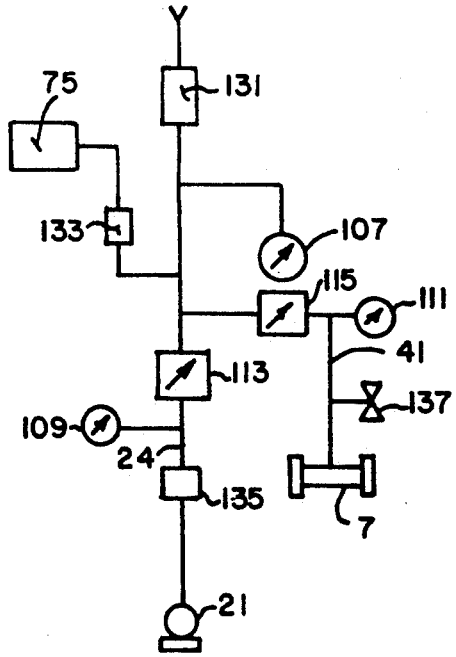
FIG. 8 is a pneumatic circuit diagram of the system of FIGS. 1-7.

As shown in FIG. 8, air from a central or local compressor enters the system through a filter 131 at a pressure of 100 psi (6.9 bar) or greater. Line pressure is displayed on gauge 107. The pressure is applied through an oiler 133 to the pneumatic valve actuator 75, where it holds the valve in an open or closed position determined by an electrically controlled solenoid portion of the actuator. Pressure is applied through the manual regulator 113 and an oiler 135 to the dual chamber pump 21. Pump pressure is displayed on gauge 109. The speed of the pump, for a given pumped material and back pressure, is adjusted by the regulator 113. Absolute flow rate is not measured or controlled, however, in this preferred embodiment. Pressure in the jacket 29 of the pulse dampener 7 is controlled by manual regulator 115, and displayed by gauge 111. A relief valve 137 is preferably set at about 50 psi to prevent excess pressure in the PVC jacket 29, although the jacket is capable of sustaining higher pressures. Therefore, the relief valve 137 may be set at any pressure appropriate to pump pressure.

Figure 9:
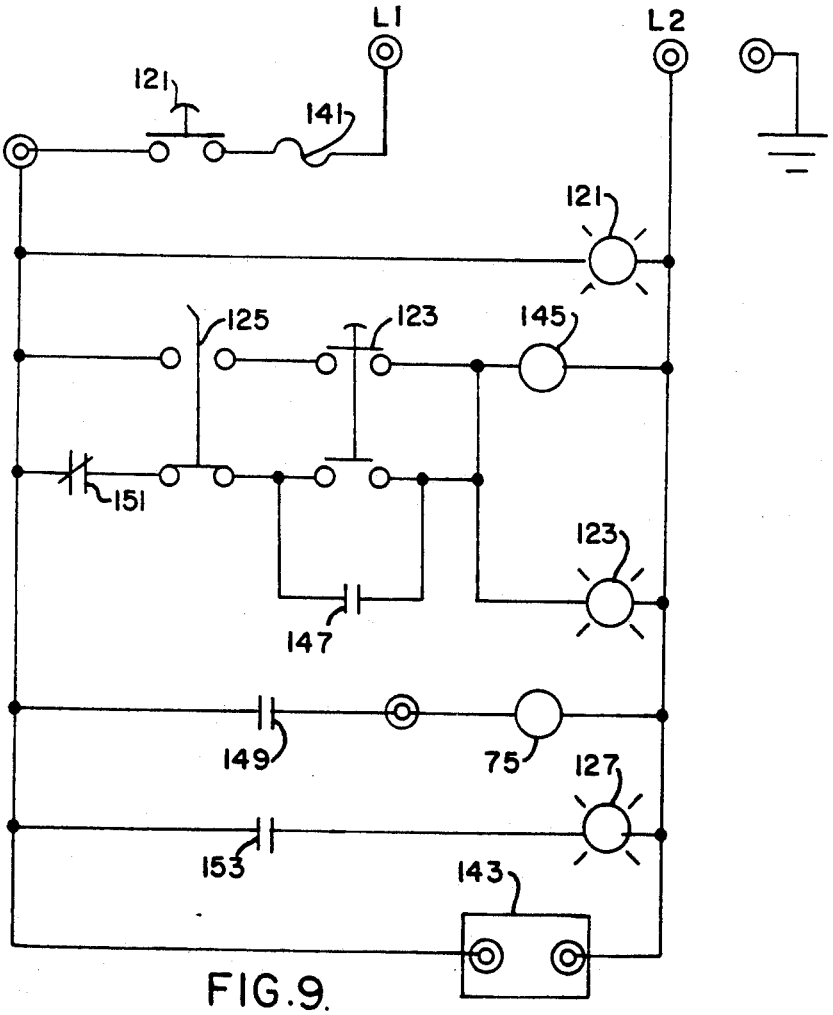
FIG. 9 is an electrical circuit diagram of the system of FIGS. 1-8.

As shown in FIG. 9, the electrical control circuitry includes, in addition to the components already described, a two-amp fuse 141, a photoelectric switch 143, and a fill relay 145. The fill relay 145 includes two normally open switches 147 and 149. The photoelectric switch 143 is controlled by the sensor 101 and includes a normally closed switch 151 and a normally open switch 153. Power through fuse 141 and power switch 121 lights the power-on switch light 121. In an automatic mode setting of switch 125, as shown in FIG. 9, a circuit is completed through normally closed switch part 151 of the photoelectric switch 143, through a lower set of contacts of the fill switch 123, and then through both a fill relay 145 and the light portion of the switch 123. Depression of push-button switch 123 lights its light 123 and also activates relay 145, closing its two normally open switches 147 and 149. The first switch 147 is connected across the fill switch 123 and holds the relay activated after the fill button 123 is released. The second switch 149 activates the solenoid portion of the pneumatic valve 75, quickly changing the position of the valve from closed to open. When the sensor 101 signals that the level of pigment dispersion 13 has reach®d the desired point, switch 151 opens, the fill relay 145 is deactivated, and the container full light is activated through the switch 153.

In a manual mode, the switch 125 is in its upper position, fill relay 145 is activated by the push button switch 123, but its first switch 147 is not activated. Therefore, the valve solenoid 75 is activated only so long as the fill button 123 is depressed. The second switch 153 of the photoelectric switch 143 also remains in the circuit, and lights the container full light 127 when the desired level is reached, although filling continues until the button 123 is released.

In the operation of the system 1, the PAL 15 is mounted on a drum 11 containing a desired iron oxide pigment dispersion. The pump 21 is attached to an air source providing a pressure of at least 100 psi (6.9 bar). All quick-connect connections are made and checked, and the pressure control valves 113 and 115 are adjusted to their expected optimal positions. A nozzle 79, chosen for the size containers to be filled and the flow rate desired, is connected to the outlet coupling 77 of the ball valve 71. The system is turned on. A container 83, filled to the desired height with iron oxide dispersion, is slid against the apex of the "V" formed by the guide rails 65, and the thumb screw 99 is loosened sufficiently to allow the sensor 101 to be positioned over the open mouth of the container 83 and moved vertically until the "full" light 127 turns on, indicating that the container is full. The thumb screw 99 is then tightened to hold the sensor 101 just below the position at which the light 127 first turns on, in order to compensate for the time required to close the valve 71 and stop all flow into the container. If, after filling several containers on automatic setting, it is determined that more or less compensation is needed, the sensor 101 is moved a short distance up or down. It will be understood that compensation may be made in other ways, such as electronically or by filling the test container slightly less full than desired or by providing a micrometer adjustment of the sensor position.

The pressure control valves 113 and 115 are then adjusted to give a desired flow rate compatible with the material being dispensed and the size of the container 83 being filled. The pulse dampener pressure is set to give a sufficiently smooth flow to provide complete and prompt cutoff of flow without dripping when the ball valve 71 is closed.

Containers are slid across the counter top onto the grid 59, where they are quickly positioned by the guide rails 65. The start button 123 is momentarily depressed, the valve 71 is opened, and the container 83 fills at a rate of about three gallons per minute. This rate permits about six to ten one-quart containers to be filled per minute. A somewhat higher flow rate may be desired for larger containers. When the sensor 101 detects that the level has reached the desired height, its circuitry turns on the light 127 and turns off the valve 71. The container 83 is then slid across the grid 59 onto the counter top, for packaging, accumulation, or removal for use. All of these steps may be carried out without lifting the container.

When containers of a different size are to be used, the nozzle 79 is removed and a new one of a length and diameter appropriate to the container size is connected to the coupling 77. Generally, no adjustment of the guide rails 65 is necessary. The system is returned to manual operation, and the height and position of the sensor 101 is readjusted. Filling operations may then be resumed without further adjustments, unless the pressure valves 113 and 115 are adjusted to change the fill rate.

Any drips which occur while no container is under the nozzle 79 will fall through the opening 63 to the drain 57. If the drain is not being used, the bottom of the basin 55 may be lined with a paper towel for easy clean-up. Any splashes will be broken up and caught on the bottom of the grid 59. Should a drip fall on the grid 59, it can easily be cleaned before it fouls the bottom of a container.

When a different liquid (e.g., an iron oxide pigment dispersion of a different color) is to be dispensed, or when the filling operation is completed for the day, or a fibre drum 11 is emptied, the system must be thoroughly cleaned. The system 1 is particularly well suited to easy cleaning. The nozzle 79 is removed and replaced with a hose. A drum is filled with water and the PAL 15 is moved to that drum. If the drum 11 is empty, it may itself be filled with water. The hose at the outlet side of the system is then also led into the drum, and the system is operated continuously until it is thoroughly flushed. If desired, the drum may be refilled with clean water, and the system is again recycled to provide final cleaning. If contamination is not a problem, the outlet hose may simply be placed in a drain.

Numerous variations, within the scope of the appended claims, will be apparent to those skilled in the art in light of the foregoing description and accompanying drawings. Merely by way of example, a hose pump of the type utilizing a rotating eccentric cam to squeeze the delivery hose may replace the dual diaphragm pump. Such a pump is more expensive and has a lower capacity, but has the advantages that it provides less pulsation, thus potentially eliminating the pulse dampener, that it starts and stops repidly and blocks flow when it stops, thereby making possible the elimination of the ball valve, and that it is reversible, making it possible to clean the system by reverse flushing.

The source of the pigment dispersion may be a mixer or other hopper, or the material may be gravity-fed. The material may be other liquids having other viscosities, ranging from low viscosity systems to heavy pastes or greases.

The sensor may be of a different type, such as a radar or acoustic sensor, which are sometimes more sensitive to ambient interference, but which may detect overfilling more reliably. The container may be a glass jar, a pail, or other open-topped, rigid containers. Alternatively, a flexible container, such as a bag-in-box container, may be attached directly to the outlet nozzle, and the full condition of the bag may be detected by a weight sensor, a pressure sensor, or a sensor which detects expansion of the bag within the box.

Many of the features of the invention are usable in other combinations. These variations are merely illustrative.

I claim:

1. A container filling device comprising a liquid source, a dispensing nozzle having an inside diameter, a valve between the nozzle and the liquid source, a mechanical actuator for the valve, and a horizontal support surface for a container below the nozzle, characterized by (a) barrier means for separating the nozzle and the support surface on a front side of the barrier means from the liquid source and the valve actuator on a rear side of the barrier means;

(b) positioning means in the support surface for positioning a container below the nozzle and opening means in the support surface for permitting liquid to pass through the support means when a container is not positioned below the nozzle, the opening means having a diameter at least as large as the inner diameter of the nozzle;

(c) the nozzle comprising an outlet tube and a plurality of nozzle heads, each of the plurality of nozzle heads comprising quick-connect coupling means for attaching the nozzle head to the outlet tube, the outlet tube being fixed in height with respect to the horizontal support surface, each of the plurality of nozzle heads being of different lengths to provide a nozzle outlet spaced a desired distance above containers of different heights;

(d) a liquid depth sensor vertically adjustable with respect to the nozzle for accommodating containers of different heights; and (e) the liquid source comprising a container separate from the device, a pulsating pump for drawing liquid from the container, and a pulse dampening means between the pump and the valve, the pulse dampening means comprising a length of flexible tubing for carrying the liquid, a jacket around and spaced from the length of tubing, and means for controlling pressure in the jacket.

2. A container filling device comprising a source of liquid, a dispensing nozzle, a valve between the nozzle and the liquid source, a mechanical actuator for the valve, a mechanical linkage connecting the mechanical actuator to the valve, a horizontal support surface for a container below the nozzle, and barrier means for separating the nozzle, the valve, and the support surface on a front side of the barrier means from the liquid source and the valve actuator on a rear side of the barrier means, the mechanical linkage extending through the barrier means.

3. The container filling device of claim 2 wherein the barrier means is a generally imperforate, vertical plate extending horizontally on either side of the nozzle and extending vertically from the support surface to above an outlet of the nozzle.

4. The container filling device of claim 3 further comprising a liquid depth sensor on a front side of the plate and depth sensing circuitry connected to the sensor, the depth sensing circuitry being mounted on the rear of the plate, and further comprising manually operable control means mounted on the front side of the plate for initiating a filling operation, and control circuitry connected to the manually operable control means, the control circuitry being mounted on the rear side of the plate.

5. The container filling device of claim 2 further comprising a liquid depth sensor on a front side of the barrier means and depth control circuitry connected to the sensor, the depth control circuitry being on the rear of the barrier means.

6. The container filling device of claim 5 wherein the nozzle comprises an outlet tube on the front side of the barrier means and a plurality of nozzle heads, each of the plurality of nozzle heads comprising quick-connect coupling means for attaching the nozzle head to the outlet tube, the horizontal support surface being fixed with respect to the outlet tube, each of the plurality of nozzle heads being of different lengths to provide a nozzle outlet spaced a desired distance above containers of different heights.

7. The container filling device of claim 6 wherein the liquid depth sensor is vertically adjustable with respect to the outlet tube for accommodating containers of different heights.

8. The container filling device of claim 7 including indicator means connected to the depth control circuitry for indicating a full condition of the container, whereby the depth sensor can be adjusted for a particular container size by placing a full container under the depth sensor and adjusting its vertical position until the indicator means indicates a full condition.

9. A container filling device comprising a source of liquid, a dispensing nozzle, and a horizontal support surface for a container below the nozzle, characterized in that the nozzle comprises an outlet tube and a plurality of nozzle heads, each of the plurality of nozzle heads comprising quick-connect coupling means for attaching the nozzle head to the outlet tube, the outlet tube being fixed in height with respect to the horizontal support surface, each of the plurality of nozzle heads being of different lengths to provide a nozzle outlet spaced a desired distance above containers of different heights.

10. The container filling device of claim 9 wherein each nozzle outlet comprises a tube, at least a major portion of the length of the tube being filled with a plurality of capillary tubes friction fit into the nozzle tube.

11. The container filling device of claim 10 wherein each of said plurality of capillary tubes has an inner diameter of from 0.05" to 0.5".

12. The container filling device of claim 9 further comprising a liquid depth sensor vertically adjustable with respect to the outlet tube for accommodating containers of different heights.

13. In a container filling device comprising a liquid source, a dispensing nozzle, a valve between the nozzle and the liquid source, an actuator for the valve, and a horizontal support surface for a container below the nozzle, the improvement wherein the liquid source comprises a container separate from the device, a pulsating pump for drawing liquid from the container in pulses, and a pulse dampening means between the pump and the valve for controllably reducing the magnitude of the pulses, the pulse dampening means comprising a length of flexible tubing for carrying the liquid, a jacket around and spaced from the tubing, and means for controlling pressure in the jacket.

14. The improvement of claim 13 wherein the pump is pneumatically operated, and including a control panel on which the valve is mounted, the control panel including separate controls for air to the pump and for air to the jacket of the pulse dampening means.

15. A container filling device comprising a source of liquid, a dispensing nozzle, a valve between the nozzle and the liquid source, a mechanical actuator for the valve, a horizontal support surface for a container below the nozzle, a barrier means for separating the nozzle and the support surface on a front side of the barrier means from the liquid source and the valve actuator on a rear side of the barrier means, a liquid depth sensor on a front side of the barrier means and depth control circuitry connected to the sensor, the depth control circuitry being on the rear of the barrier means, the nozzle comprising an outlet tube on the front side of the barrier means and a plurality of nozzle heads, each of the plurality of nozzle heads comprising quick-connect coupling means for attaching the nozzle head to the outlet tube, the horizontal support surface being fixed with respect to the outlet tube, each of the plurality of nozzle heads being of different lengths to provide a nozzle outlet spaced a desired distance above containers of different heights.

* * * * *

UNITED STATES PATENT AND TRADEMARK OFFICE

CERTIFICATE OF CORRECTION

PATENT NO. : 5,159,962
DATED : November 3, 1992
INVENTOR(S) : Warren A. Dow

It is certified that error appears in the above-indentified patent and that said Letters Patent is hereby corrected as shown below:

Column 7, line 62, delete "reach®d" and insert --reached--.

Signed and Sealed this

Fifteenth Day of November, 1994

*Attest:*

Bruce Lehman

BRUCE LEHMAN

*Attesting Officer*

*Commissioner of Patents and Trademarks*